United States Patent [19]

Karlsson

[11] 4,217,707

[45] Aug. 19, 1980

[54] SNOW RETAINING GATE FOR SNOW PLOW

[75] Inventor: Gustav Karlsson, Linköping, Sweden

[73] Assignee: GK Haninge Maskiner AB, Linköping, Sweden

[21] Appl. No.: 2,714

[22] Filed: Jan. 11, 1979

[30] Foreign Application Priority Data

Jan. 24, 1978 [FI] Finland ..... 780210

[51] Int. Cl.[3] ..... E01H 5/00

[52] U.S. Cl. ..... 37/41; 172/784

[58] Field of Search ..... 37/41, 42, 42 VL, 117.5, 37/50; 172/784

[56] References Cited

U.S. PATENT DOCUMENTS

| | | | |
|---|---|---|---|
| 2,218,512 | 10/1940 | Ball | 37/42 R |
| 2,763,943 | 9/1956 | Lotz | 37/42 R X |
| 3,055,126 | 9/1962 | Emhof | 37/42 R |
| 3,208,166 | 9/1965 | Proulx | 37/42 R |
| 3,279,104 | 10/1966 | Wandscheer et al. | 37/41 |
| 3,373,515 | 3/1968 | Schneider | 37/50 |
| 3,374,562 | 3/1968 | Glesmann | 37/50 |
| 3,411,590 | 11/1968 | Batko | 37/50 |
| 4,019,268 | 4/1977 | Waterman | 37/41 |
| 4,077,139 | 3/1978 | Fagervold et al. | 37/41 |

*Primary Examiner*—Eugene H. Eickholt
*Attorney, Agent, or Firm*—James E. Nilles

[57] ABSTRACT

In a snow plow having a horizontally elongated blade that extends lengthwise obliquely to the direction of plow travel, a snow retaining gate is mounted in front of the plow blade to swing flatwise about a horizontal axis near the top of the plow blade and substantially parallel to the direction of plow travel. When raised, the gate wall is substantially horizontal but has downwardly concave curvature from rear to front for close fit of its rear portion under the forwardly-upwardly curved upper portion of the plow blade. The rear edge of the gate wall has a curved upper portion so that when the gate wall is in lowered substantially upright position its rear edge, along the full height thereof, is contiguous to the front surface of the plow blade. When in lowered position the gate wall is oriented substantially parallel to the direction of plow travel and thus prevents formation of a secondary snow bank.

3 Claims, 2 Drawing Figures

SNOW RETAINING GATE FOR SNOW PLOW

TECHNICAL FIELD OF THE INVENTION

This invention relates to snow plows for mounting on trucks and the like, of the type comprising a horizontally elongated blade that extends obliquely to the normal direction of travel of a vehicle on which the plow is mounted; and the invention is more particularly concerned with an improved snow retaining gate for such a snow plow.

BACKGROUND OF THE INVENTION

A snow retaining gate for a snow plow, of the general type to which this invention relates, was disclosed in U.S. Pat. No. 3,407,519. As was conventional, the horizontally elongated blade of the plow of that patent extended lengthwise obliquely to the normal direction of travel of the vehicle that carried it, so that one end of the blade trailed the other relative to that direction of travel. As such a plow blade moves forward during plowing, snow displaced by the blade slides lengthwise along it to its trailing end and then normally continues on out beyond that end to form a snow bank bordering the swath that the blade has plowed. Such a snow bank is of course objectionable when it is thrown across a driveway or cross-walk that intersects the plowed street or road. Therefore, to prevent formation of a snow bank when the plow crossed a driveway or the like, the snow plow of the patent had a snow retaining gate swingably mounted in front of its blade, near the trailing end thereof. For normal plowing, the gate was maintained in a raised inoperative position in which it was substantially horizontal and was out of the way of snow moving along the lower portion of the blade. When the plow was to cross a driveway or the like, the gate was lowered to an operative position in which it was substantially vertical and extended forwardly from the blade so that it lay across the path of snow moving along the blade and prevented such snow from flowing out beyond the trailing end of the blade and forming a snow bank.

In the snow plow of that patent, the gate swung about a shaft that projected forwardly from the plow blade at a level about midway between the top and bottom edges of the blade. The gate was connected to the shaft by means of an arm that projected laterally from the shaft, and in both positions of the gate its upper edge extended substantially parallel to the shaft axis. So that the gate could be swung to its inoperative position without interference from the forwardly curved upper portion of the plow blade, the height of the gate, as measured in its operative position, was only about half that of the blade; and therefore if any substantial accumulation of snow was being retained by the gate, a substantial portion of that snow would flow over its relatively low top edge, forming a snow bank such as the gate was intended to prevent.

Another prior snow retaining gate arrangement for a snow plow is disclosed in Swedish Pat. No. 7401343-4, published Sept. 13, 1976. When the snow retaining gate of that patent was in its lowered operative position, it extended forwardly from the plow blade at an oblique angle to the direction of travel such that its front edge projected laterally beyond its rear edge. That orientation of the snow retaining gate at an outwardly oblique angle to the direction of travel had the same major disadvantage as the insufficiently high gate of the U.S. patent, that is, it permitted formation of a secondary snow strand or snow bank across a driveway or cross-walk that was intended to be kept clear, especially during plowing of very deep snow or when a relatively wide driveway or the like was to be crossed by the plow. In this case, however, the secondary snow bank was formed by snow flowing out around the front edge of the gate.

The general object of the present invention is to provide a snow plow having a snow retaining gate which is substantially more effective when in its operative position than prior such devices and which, in particular, does not permit a secondary snow bank to develop even when a substantially large quantity of snow accumulates near the discharge end of the plow blade.

Another object of this invention is to provide a snow retaining gate of the character described that is sturdy in itself and does not impose any unduly high forces upon the structure by which it is carried.

SUMMARY OF THE INVENTION

In general, the objects of the invention are achieved with a snow plow comprising a horizontally elongated plow blade having a substantially vertical lower portion and an upwardly and forwardly curved upper portion, said plow blade being adapted for mounting on a carrying vehicle with its length extending obliquely to a normal direction of travel of the vehicle so that one end of the plow blade is substantially behind the other in said direction of travel, and a snow retaining gate in front of the plow blade, near said one end thereof, said gate comprising a gate wall and being swingable between a raised position in which said gate wall is substantially horizontal and is at a level near the top of the plow blade and a lowered position in which the gate wall is substantially upright and has a lower edge near the level of the lower edge of the plow blade, said snow plow being characterized by: said gate being mounted for swinging motion about a substantially horizontal axis which extends at an oblique angle to the length of the plow blade such that said axis is substantially parallel to said normal direction of travel; said gate wall having a rear portion which is adjacent to the plow blade and which, with the gate in raised position, curves rearwardly and downwardly to closely underlie the curved upper portion of the plow blade, a top edge which, with the gate in lowered position, is near the level of the top of the plow blade, and a rear edge which, with the gate in lowered position, is contiguous all along its length to the front surface of the plow blade; and said gate wall being substantially parallel to said axis so that when the gate is in its lowered position its wall extends edgewise substantially in the direction of vehicle travel and snow accumulating in the corner defined by the plow blade and the gate wall is prevented from passing around the gate wall.

BRIEF DESCRIPTION OF THE DRAWINGS

In the accompanying drawings, which illustrate an embodiment of the invention now regarded as the preferred mode of practicing the essentials thereof that are defined by the accompanying claims:

DETAILED DESCRIPTION OF THE INVENTION

Figure 1:
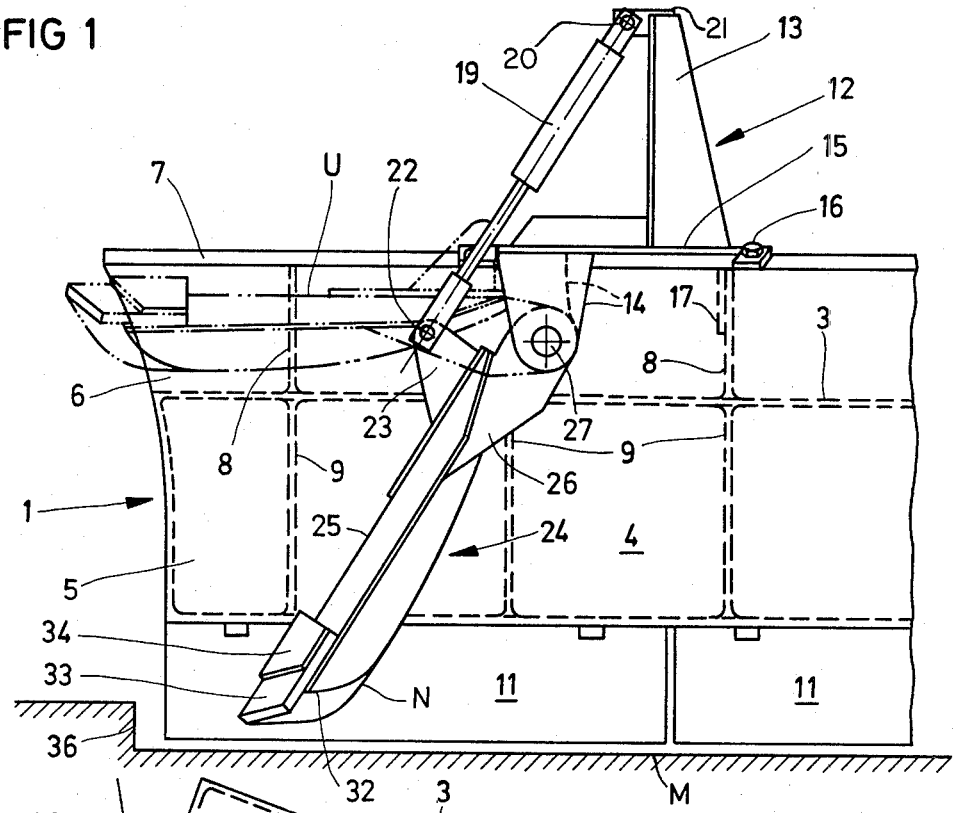
FIG. 1 is a view in elevation of a portion of a snow plow incorporating a snow retaining gate that embodies the principles of the invention, the plow blade being seen from in front of the same and only that portion of the blade being shown that is in the neighborhood of the snow retaining gate.
Figure 2:
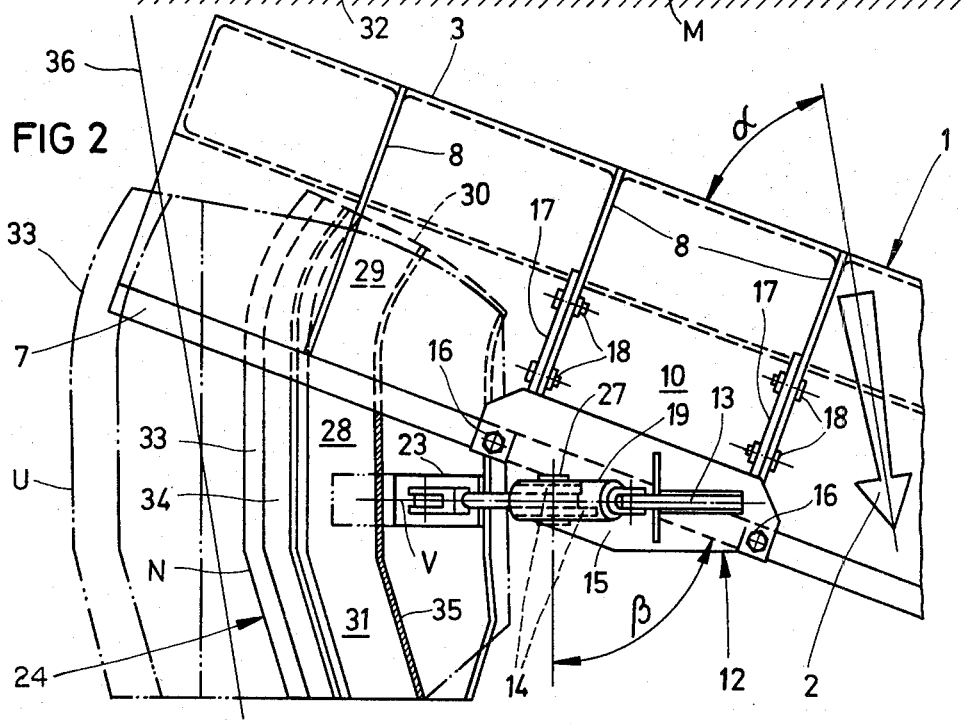
FIG. 2 is a plan view of the portion of the snow plow shown in FIG. 1.

Referring now to the accompanying drawings, the numeral 1 designates generally a horizontally elongated snow plow blade that is intended to be mounted on the front of a truck or other suitable vehicle by which the blade is carried for motion in a normal plowing direction designated by the arrow 2. The plow blade 1 is mounted on the carrying vehicle by means of structure which is conventional and is therefore not illustrated. The blade, as viewed from above, extends lengthwise obliquely to the direction of normal travel denoted by the arrow 2, at an angle $\alpha$ to the travel direction that is on the order of 60° to 70°.

By reason of this lengthwise diagonal orientation of the blade, one of its ends (i.e., its end that is shown in the drawings) trails behind its other end. As a result of the inclination of the blade to the travel direction, snow that it encounters as it moves forward is displaced lengthwise along the blade towards its trailing end, which can thus be regarded as the discharge end of the blade.

The blade 1 is built up of welded iron plates that are supported and reinforced by a horizontally extending box beam 3 to which the mounting structure is attached. The several plates that comprise the plow blade are secured to the front surface of the box beam 3 and cooperate to provide a snow engaging wall or mold board 4 that has a substantially flat and vertical lower portion 5 and an upper portion 6 that curves forwardly and upwardly from the lower portion. The arcuate upper portion 6 of the wall 4 terminates at a forwardly projecting flange 7 that extends lengthwise along the top of the blade. A plurality of vertical stiffening ribs 8, 9 are secured to the snow engaging wall, on the rear surface thereof, and to the box beam 3. Extending along the length of the plow blade, beneath the box beam, are plow-shares 11 which are swingably supported from above and which are biased to a neutral position in which their surfaces are substantially vertical.

A bracket structure 12 which supports the snow retaining gate 24 of this invention is mounted on the flange 7, near the trailing end of the blade but spaced inwardly from it. The bracket 12 comprises a downwardly projecting double arm 14 that swingably supports the gate 24 and an upwardly projecting arm 13 to which there is attached one end of a hydraulic actuator 19 that swings the gate between raised and lowered position. The two arms 13 and 14 project from a flat, elongated base plate 15 that overlies the forwardly projecting flange 7 on the top of the blade and is secured to that flange by means of bolts 16. The base plate 15 is braced by a pair of fixed arms 17 that project rearwardly down from it and have their lower ends secured to the upper stiffening ribs 8 by means of bolts 18. The double arm 14 that supports the gate is in offset relation to the actuator supporting arm 13, being closer to the trailing end of the blade, but both of those arms are symmetrical to a laterally extending vertical plane V that is transverse to the direction of motion 2 and extends through the base plate 15.

The snow retaining gate comprises a wall 25 that is more or less rectangular in plan-form. Projecting from an inner surface of that wall is a carrying arm 26 that is connected by means of a pivot pin 27 with the downwardly projecting double arm 14 of the bracket structure 12 and is confined between the bifurcations of that double arm. The axis of the pivot pin 27 is horizontal and normal to the above-mentioned plane of symmetry V; hence, as viewed from above, the axis about which the gate swings is at an angle $\beta$ to the length of the blade. The angle $\beta$ is approximately equal to the angle $\alpha$ between the blade and the direction of normal motion, and thus the swinging axis of the gate is substantially parallel to the direction of plow motion.

The hydraulic actuator 19 for the gate can be a double-acting cylinder motor that is communicated in a conventional manner with the hydraulic system of a vehicle that carries the plow. One of its ends is connected with the upwardly projecting bracket arm 13 by means of a pivot pin 21 that has its axis parallel to the swinging axis of the gate. The other end of the actuator 19 is connected by means of a pivot pin 22 to a short actuating arm 23 that is fixed to the gate wall 25 and projects out from the outer surface thereof. Contraction of the cylinder motor 19 swings the gate to a raised position designated by U, and its extension swings the gate down to an operative position designated by N.

Attention is directed to the fact that the upper edge of the gate wall 25 extends substantially parallel to the axis about which the gate swings and is spaced only a small distance from that axis, and that said axis, in turn, is only slightly below the level of the top of the plow blade 1.

The gate wall 25 has a flat medial portion 28 which extends from its top edge nearly to its bottom edge and which is parallel to the axis about which the gate swings. The arms 23 and 26 project from that medial gate wall portion 28. The rear portion 29 of the gate wall, which is adjacent to the mold board or snow engaging wall 4 of the plow blade, is somewhat curved, the amount and direction of its curvature being such that when the gate is in its raised position U, in which its flat medial portion 28 is substantially horizontal and is near the level of the top of the blade, said curved rear portion 29 of the gate fits closely under the arcuate upper portion of the blade, more or less matching its curvature. The front marginal portion 31 of the gate wall is at a small oblique angle to the flat medial portion 28 of that wall, so that considering the gate in its raised position, its wall as a whole has a slight downwardly concave curvature from rear to front and provides, in effect, a forward and downward continuation of the forward and upward curvature of the upper portion 6 of the plow blade. During plowing, therefore, the raised gate wall deflects rising snow downwardly and forwardly ahead of the plow blade so that such snow cannot be blown against the windshield of the vehicle that carries the plow.

At the upper portion of the gate wall 25 its rear edge 30 is curved along its length, the curvature of that edge portion being substantially matched to the forward and upward curvature of the upper portion 6 of the plow blade so that when the gate is in its lowered position N, there will be substantially no gap between the front surface of the plow blade and the rear edge 30 of the gate wall. Snow is thus prevented from escaping from between the blade and the gate.

A wear blade 33 of elastic material is secured to the lower edge portion of the gate wall by means of a clamping band 34 and extends a little distance below the lower edge of the gate wall.

It will be seen that when the gate of this invention is in its lowered position, its wall 25 is substantially aligned with the direction of travel of the carrying vehicle. Hence, after the gate is lowered for plowing across a cross-walk or driveway, the snow caught by the plow blade continues to accumulate in front of it, inasmuch as the gate confines such snow against escape at the trailing end of the plow blade. Because the gate wall 25 extends substantially parallel to the direction of travel—rather than obliquely forwardly and outwardly relative to that direction, as in the case of prior snow retaining gates —there is no tendency for the gate wall to pick up additional snow and sweep it into the corner defined by it and the plow blade. Hence, for a given distance of plow travel, less snow accumulates in that corner than with an obliquely oriented gate wall, and consequently there is less chance for snow to begin flowing around the front edge of the gate. With prior gates that extended obliquely to the direction of travel, snow moving lengthwise along the plow blade towards its trailing end could be deflected forwardly by the gate and could therefore pass around its front edge to produce a secondary snow bank across a driveway or the like that was to be kept clear. With the gate of this invention, the included angle between the gate wall and the plow blade is less than 90°, and therefore the gate wall 25 can not impart any forward defection to snow moving along the plow blade but, on the contrary, tends to compact such snow in the corner that it defines with the blade. Furthermore, snow can accumulate to a very substantial depth in that corner without escaping over the gate, because the top edge of the gate wall 25 is near the level of the top edge of the plow blade.

From the foregoing description taken with the accompanying drawings it will be apparent that this invention provides a snow plow with a snow retaining gate that can be lowered as the plow crosses a cross-walk or driveway to prevent formation of a snow bank thereacross, and that the snow retaining gate of this invention is substantially more effective than prior such devices because it does not permit a secondary snow bank to be formed across the driveway or cross-walk but instead leaves it with clean access to the plowed street or road.

I claim:

1. A snow plow of the type comprising a horizontally elongated plow blade having a substantially vertical lower portion and an upwardly and forwardly curved upper portion, said plow blade being adapted for mounting on a carrying vehicle with its length extending obliquely to a normal direction of vehicle travel so that one end of the plow blade is substantially behind the other in said direction of travel, and a snow retaining gate in front of the plow blade near said one end thereof, said gate comprising a gate wall and being swingable between a raised position in which said gate wall is substantially horizontal and is at a level near the top of the plow blade and a lowered position in which the gate wall is substantially upright and has a lower edge near the level of the lower edge of the plow blade, said snow plow being characterized by:

A. said gate being mounted for swinging motion about a substantially horizontal axis which extends at an oblique angle to the length of the plow blade such that said axis is substantially parallel to said normal direction of travel;

B. said gate wall having (1) a rear portion which is adjacent to the plow blade and which, with the gate in raised position, curves rearwardly and downwardly to closely underlie the curved upper portion of the plow blade, (2) a top edge which, with the gate in lowered position, is near the level of the top of the plow blade, and (3) a rear edge which, with the gate in lowered position, is contiguous all along its length to the front surface of the plow blade; and C. said gate wall being substantially parallel to said axis so that when the gate is in its lowered position its wall extends edgewise substantially in the direction of vehicle travel and snow accumulating in the corner defined by the plow blade and the gate wall is prevented from passing around the gate wall.

2. The snow plow of claim 1 wherein said gate wall is curved from front to rear thereof so that with the blade in raised position its curvature is downwardly concave and complements the curvature of the upper portion of the plow blade.

3. A snow plow of the type comprising a horizontally elongated plow blade having a substantially vertical lower portion and an upwardly and forwardly curved upper portion, said plow blade being adapted for mounting on a carrying vehicle with its length extending obliquely to a normal direction of vehicle travel so that one end of the plow blade is substantially behind the other in said direction of travel, and a snow retaining gate in front of the plow blade near said one end thereof, said gate comprising a gate wall mounted for swinging motion about an axis which extends substantially horizontally and at an oblique angle to the length of the plow blade to be oriented substantially in said direction of vehicle travel, whereby the gate is carried between a raised position in which said gate wall is substantially horizontal and is at a level near the top of the plow blade and a lowered position in which the gate wall is substantially upright and has a lower edge near the level of the lower edge of the plow blade, said snow plow being characterized by:

A. said gate wall having (1) a rear portion which is adjacent to the plow blade and which, with the gate in raised position, curves rearwardly and downwardly to closely underlie the curved upper portion of the plow blade, (2) a top edge which, with the gate in lowered position, is near the level of the top of the plow blade, and (3) a rear edge which, with the gate in lowered position, is contiguous all along its length to the front surface of the plow blade; and B. said gate wall, in its lowered position, extending edgewise at an acute angle to the length of the plow blade and substantially in the direction of vehicle travel so that snow accumulating in the corner defined by the plow blade and the gate wall is prevented from passing around the gate wall.

* * * * *